US005171100A

United States Patent [19]

Bergstedt et al.

[11] Patent Number: 5,171,100

[45] Date of Patent: Dec. 15, 1992

[54] PREFORMED EXPANSION JOINT SYSTEM

[76] Inventors: Jan-Eric O. Bergstedt, 5601 Dewey Hill Rd., Edina, Minn. 55349; Jerry W. Ferr, 7912 School Rd., Eden Prairie, Minn. 55344

[21] Appl. No.: 626,273

[22] Filed: Dec. 12, 1990

[51] Int. Cl.[5] ..... E01C 11/02; E01C 11/08

[52] U.S. Cl. ..... 404/68; 404/67; 404/57; 52/573; 403/225

[58] Field of Search ..... 52/573, 396; 404/68, 404/65, 67, 56, 47, 57, 58; 403/225

[56] References Cited

U.S. PATENT DOCUMENTS

| | | | |
|---|---|---|---|
| 3,720,474 | 3/1973 | Stog et al. | 404/47 |
| 3,822,428 | 7/1974 | Stog et al. | 52/573 X |
| 3,849,958 | 11/1974 | Balzer et al. | 52/573 X |
| 3,974,614 | 8/1976 | Strong | 404/68 X |
| 4,295,311 | 10/1981 | Dahlberg . | |
| 4,349,401 | 9/1982 | Dahlberg . | |
| 4,362,430 | 12/1982 | Ceintrey | 404/68 |
| 4,699,540 | 10/1987 | Gibbon et al. | 404/67 X |
| 4,773,791 | 9/1988 | Hartkorn | 52/573 X |
| 5,082,394 | 1/1992 | George | 404/57 X |
| 5,088,256 | 2/1992 | Face, Jr. | 52/573 X |

OTHER PUBLICATIONS

Bickley, et al., "Repair and Protection Systems for Parking Structures", Concrete International, Apr. 1988, pp. 21-28.

"TREM-SPAN Traffic Bearing System" brochure, Tremco, Inc., undated.

"ISO-FLEX Factory Molded Urethane Expansion Joint Sealing System" brochure, Harry S. Peterson, Inc., Jul. 1980.

"Specification Data, Preformed Expansion Joint System with Epoxy Edging" brochure, Pecora Corp., Apr. 1983.

"WABE DATA" brochure, Watson-Bowman & Acme Corp., undated.

"Expansion Joint Assemblies" brochure, MM Systems Corp., undated.

"PERMAPOL WJ Traffic System" spec sheet, Products Research & Chemical Corp., May 1988.

"PERMAPOL RC-550 Sealant" spec sheet, Products Research & Chemical Corp., Jul. 1988.

*Primary Examiner*—Peter M. Cuomo

*Attorney, Agent, or Firm*—John W. Bunch

[57] ABSTRACT

An expansion joint (14) includes a preformed resilient center section (16), which is preferably formed of epoxy modified urethane, having reinforcing members (18) bonded along opposite edges thereof in order to provide a better bond width the adhesive bedding compound (19) and onto the respective structural members (10, 12) while minimizing overall joint with an suspectability to damage and/or cohesive failure. The preformed resilient center section (16) and the recesses of the structural members (10, 12) in which it is received are preferably offset from the gap (24) in an asymmetrical configuration.

17 Claims, 2 Drawing Sheets

PREFORMED EXPANSION JOINT SYSTEM

TECHNICAL FIELD

The present invention relates generally to an expansion joint system. More particularly, this invention concerns an expansion joint element incorporating a preformed substantially continuous center section of resilient material for forming a water tight, traffic-bearing surface between two adjacent members in structures such as parking ramps, warehouses, bridges, decks, and the like which are subject to heavy traffic and wear loads.

BACKGROUND ART

Structures such as bridges, parking ramps and the like are typically built to allow for thermal expansion and contraction of the structural members in accordance with daily and/or seasonal variations in temperatures Gaps are provided between adjacent structural sections to allow for such characteristics, and various materials are utilized to form joints to bridge the gaps. Such joint materials must allow for the expansion, contraction and other movement of the structural members, as well as provide protection against water penetration. They must also be durable enough to withstand wear and tear from vehicular and/or pedestrian traffic, snow removal equipment, road chemicals, and other hazards.

Various joint materials have been utilized heretofore. Some joint materials comprise a rubber or synthetic rubber seal or bellows section incorporated into a metal nosing which is secured to the adjacent structural members. Such joint materials are expensive to make and install, and are very difficult to repair if damaged. Further, the bellows section tends to collect dirt and debris when expanded, and can subsequently become crushed when the joint gap closes upon expansion of the structural members. The same problem is present with so called compression seals, which include a preformed flexible material placed in the joint gap under compression.

Another commonly used type of joint materials are known in the industry as T-joints because portions of the structural sections adjacent to the gap are cut away to provide a recessed area below the top surface which, together with the joint gap cross section, form a T-shaped outline. Such T-joint materials are commercially available from various suppliers in many sizes and configurations. T-joints are relatively inexpensive and provide a joint surface which is generally even and flush with the top surface of the structural members; however, if they are not prefabricated, they tend to be complicated or difficult to install, and have relatively poor strength and short service life.

Such T-joints typically consist of a thin center section of resilient material, which is usually bonded to the adjacent structural members with an epoxy based adhesive and which is supported by an underlying metal traffic-bearing plate. The thin resilient center section is either prefabricated or poured in place. Only relatively small areas are provided along the sides for adhesion between the center section and the structural members or the epoxy adhesive bedding compound. Stress in the joint is concentrated in these areas and the most frequent failures occur there. Incomplete or improper application of the epoxy adhesive bedding compound during installation in the field often contributes to a weakened bond between the center section and the bedding compound Because of their considerable width, such joints are susceptible to tearing by vehicle wheels while starting, stopping or turning on the joint materials, and/or by snow plows and other abrasion. Further, the relatively wide expansion joints of the prior art often tend to present a trip hazard as a result of bulging caused by compression of the resilient material due to expansion of the structural members during periods of higher temperatures. In these joints, the width is determined by the elastomeric properties of the joint materials, and the desire to reduce the cohesive and adhesive failures caused by the cyclical loads applied to the system. Thus, these joints have a width typically four to six times the expected movement in expansion and this causes the center section to be increasingly susceptible to tearing and other forces from vehicle tires, etc. resulting in adhesive and cohesive failure in the joint materials.

A need has thus arisen for an improved expansion joint system incorporating a preformed substantially continuous resilient center section which is reinforced along the edges in order to increase overall adhesive bond strength while minimizing joint width and susceptibility to damage and/or cohesive failure.

SUMMARY OF THE INVENTION

The present invention comprises an improved expansion joint system which overcomes the foregoing and other difficulties associated with the prior art. In accordance with the invention, there is provided an expansion joint system incorporating a preformed substantially continuous elastomeric center section having reinforced edges which provide a better bonding surface with the adhesive bedding compound and thus the adjacent structural members in order to form a water tight, traffic-bearing joint. The joint herein lends itself to construction in minimal widths, which in turn reduces susceptibility of the joint to damage from vehicle tires, snow plows, etc.

BRIEF DESCRIPTION OF DRAWING

A better understanding of the invention can be obtained by reference to the following Detailed Description in conjunction with the accompanying Drawing, wherein.

DETAILED DESCRIPTION

Figure 1:
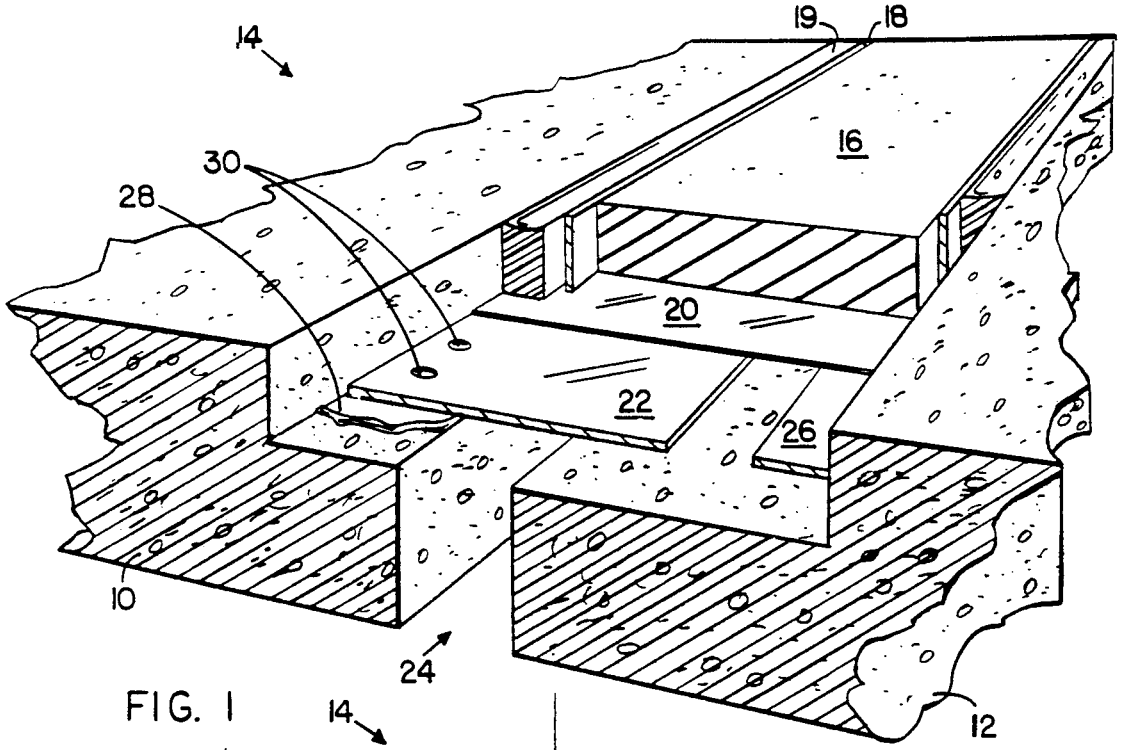
FIG. 1 is a partially cut away, perspective view of the preformed expansion joint incorporating a first embodiment of the present invention.
Figure 2:
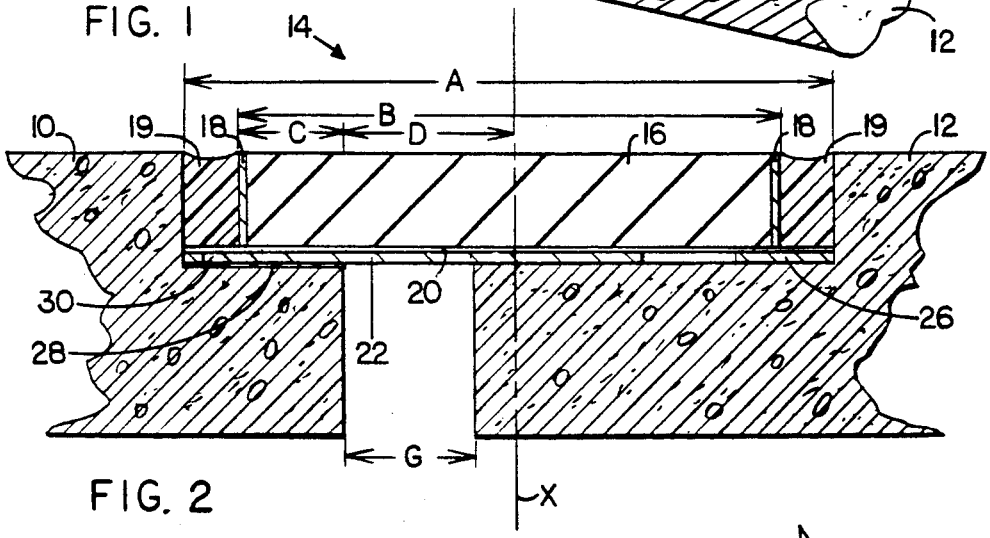
FIG. 2 is a vertical section view of the preformed expansion joint of the invention.

Referring now ,to the Drawing, wherein like reference numerals designate like or corresponding elements throughout the views, and particularly referring to FIGS. 1 and 2, there is shown a pair of adjacent structural members 10 and 12 interconnected by the preformed expansion joint 14 of the invention in order to form a water-tight, traffic bearing joint. As illustrated, the structural members 10 and 12 are precast concrete. However, the expansion joint 10 herein may be used with members 10 and 12 formed of stone, brick, wood, steel or any other suitable structural material. As will be explained more fully hereinafter, the expansion joint 14 incorporates reinforced edges which allow better bonding with the bedding material and adjacent structural members 10 and 12 in order to provide better strength and durability while minimizing width and susceptibility of the joint to damage.

The expansion joint 14 comprises a preformed, substantially continuous resilient elastomeric center section 16 having edgewise side reinforcing members 18 secured in place by bedding compound 19. The resilient center section 16 can be about ½" to 1" deep or deeper and about 1" to 6" wide or wider, depending upon the application. The center section 16 can be formed of any suitable resilient elastomeric material. In accordance with the preferred construction, the resilient center section 16 is formed of epoxy modified urethane having a hardness of between about 10° and 50° Shore A.

The reinforcing edge members 18 are preferably formed of a fiber/epoxy composite material, but could be formed of plastic, metal or any other suitable material which bonds well with the bedding compound 19 and center section 16. In accordance with the preferred embodiment, the reinforcing edge members 18 are bonded off site to the center section 16 during the manufacturing process of the joint material. This provides for development of optimal bond strength between the center section 16 and the inner surfaces of the edge members 18. During installation of the expansion joint 14, the outer surfaces of the edge members 18 are joined to the structural members 10 and 12 by application of the bedding compound 19.

As shown, the reinforcing members 18 comprise flat strips of about the same width as the thickness or depth as the center section 16, however, other configurations may be utilized.

The bedding compound 19 preferably comprises an adhesive epoxy paste of non-sag consistency having a relatively low modulus of elasticity, which bonds well with the edge members 18 of the center section 16 and the structural members 10 and 12. For example, a two part low modulus epoxy resin system having a 2:1 mix ratio of resin to hardener can be used for compound 19. Such compounds are commercially available from various suppliers.

The preformed resilient center section 14 preferably rests upon a sheet 20 of plastic which serves as a bond breaker. For example, the sheet 20 may comprise a thin sheet of PVC or polyethylene. However, the sheet 20 may not always be necessary, especially if the underlying traffic plate 22 has a non-stick surface.

Beneath the sheet of plastic 20 is a stiff traffic plate 22, which serves as the traffic load-carrying member of the joint 14. Plate 22 is secured on one side to the structural member 10 and extends over the gap 24 between the structural members 10 and 12. The traffic plate 22 can be formed of metal, such as steel or aluminium, plastic or any other suitable rigid or semirigid material. A spacer plate 26 may be provided beneath sheet 20 on the opposite structural member 12 for leveling purposes. The spacer plate 26 is preferably of the same material type and thickness as the traffic plate 22. The traffic plate 22 is preferably secured at one side by means of a layer of adhesive 28, which is preferably of the same material as the bedding compound 19. The spacer plate 26 can simply be laid in place and need not be secured to member 12.

In accordance with the preferred construction, holes 30 are provided along the edge of the traffic plate 22 in order to enhance bonding by forming plug-like welds.

Figure 3:
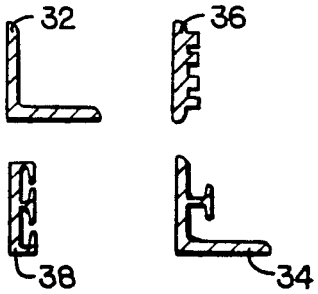
FIG. 3 comprises three illustrations of alternate forms of reinforcing members.

FIG. 3 shows several alternative configurations of the reinforcing edge members 32, 34, 36 and 38. The members 32 and 34 are of generally L-shaped configuration, whereas the members 36 and 38 comprise generally flat strips configured on one side to increase the surface contact area between the strip and the resilient center section 16.

Figure 4:
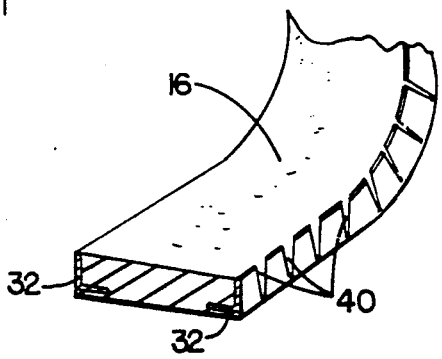
FIG. 4 is an illustration of the preformed, substantially continuous resilient center section modified to provide for the ability to roll the section for transportation and/or storage.

FIG. 4 shows a preformed center section 16 with modified reinforcing edge members 32 having notches 40 therein so that the section can be rolled into a more compact form for transportation and/or storage. For example, notches 40 can be about ⅛" width spaced about 1" apart so that the center section 16 could be rolled up into a roll of about 4' in diameter. It will be noted that the edge members 32 are shorter than the depth of the center section 16 in order to provide more contact area for bonding on both surfaces of the lateral portions of the reinforcing members.

In accordance with the preferred construction, the joint system should be positioned in such a manner that the gap opening 24 between the structural members 10 and 12 is offset from the center line X of the total assembly toward the secured edge of the traffic plate 22. This allows a larger capacity for joint gap movement than in conventional joint systems, which are symmetrical about the center line. This asymmetrical construction makes it possible to decrease the required width and/or increase movement capacity of the joint system for a particular application. This comprises a significant feature of the present invention.

In a typical T-joint system of the prior art, wherein the gap 24 is symmetrical about the center line, the resilient center section is about 10" wide and the gap opening is about 1" at 75° F. Such a system can accommodate about 1" of compression and about 2" of expansion for a total movement capacity of about 3". However, in accordance with the invention, this same movement capacity of about 3" can be accommodated herein with only about a 6" wide center section 16 together with a gap opening 24 whose middle is located about 1" from the respective edge of the center section.

Similarly, another common T-joint system of the prior art is specified to accommodate about ½" in compression and about 1" in expansion, totaling about 1½", for a gap opening about ¾" wide and a resilient center section about 6" wide. This same movement capacity can be accommodated with a center section of about 4" width arranged in asymmetrical fashion.

By placing the joint gap opening in the prescribed manner, the width of the resilient center section 16 can thus be reduced by about 25 to 40 percent, which in turn results in a joint system that accommodates the desired movement capacity while reducing the surface area subject to damage from wear and tear.

A table of example dimensions of joint 14 in asymmetrical form is as follows: where A is the overall joint width, B is the width of center section 16, C is the distance from one edge of the center section to the respective side of the joint gap 24, D is the distance from there to the centerline X of the joint, and G is the joint gap:

| | | |
|---|---|---|
| A | 5 to 5½" | 7 to 8" |
| B | 4" | 6" |
| C | ½" | ½" |
| D | 1½" | 2½" |
| G | ¾" | 1" |

The expansion joint 14 is installed as follows. First, the surfaces of the structural members 10 and 12 adjoining gap 24 should be dry and free from any frost, dirt, oil, curing compound, previous sealants, or other foreign matter so that only sound substrate material is exposed. Sand blasting is recommended. If the joint 14 is being installed as a replacement, then it is especially important to first remove all residue in order to expose a clean and dry surface. A thin layer of bedding compound or adhesive 28 is then applied to the bottom horizontal portions of the recesses in the structural member 10. This bedding compound 28 is preferably applied by scrubbing in order to fill any pores and voids in the member 10. The traffic plate 22 and any spacer plate 26 are then placed therein, followed by any bond breaker sheet 20. The preformed resilient center section 16 is then centered between the sides of the opposing recesses in the members 10 and 12, after which additional bedding compound 19 is applied in order to fill the spaces between section 16 and members 10 and 12 and bond the sides of the section via members 18 to the respective structural members. The optimum installation temperature is about 70° F. The curing time of the bedding compound is about 24 hours.

Figure 5:
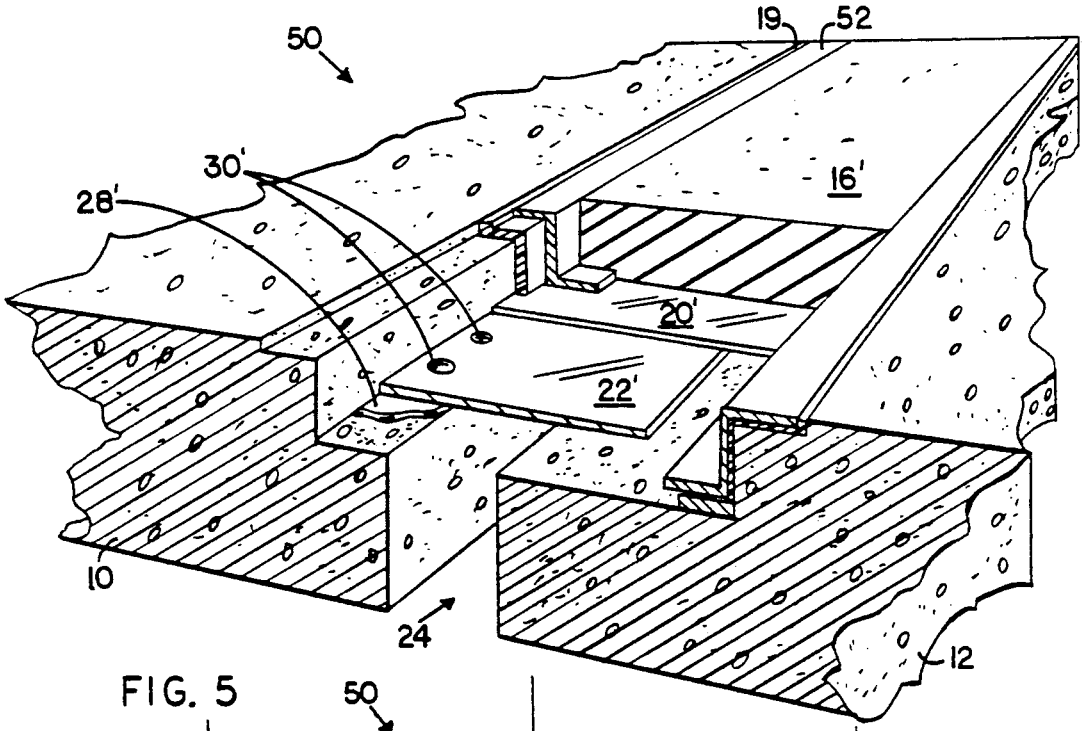
FIG. 5 is a partially cut away, perspective view of the preformed expansion joint incorporating a second embodiment of the invention.
Figure 6:
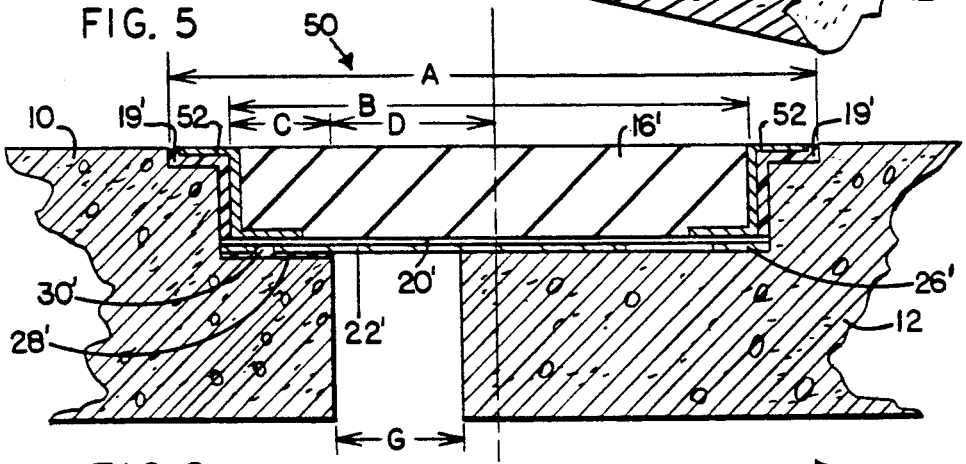
FIG. 6 is a vertical section view of the preformed expansion joint of the invention.

Referring now to FIGS. 5 and 6, there is shown a preformed expansion joint 50 incorporating a second embodiment of the invention. The expansion joint 50 incorporates several components which are substantially identical in construction and function to those in the expansion joint 14 of the first embodiment herein. The same reference numerals have been utilized to identify such components, but with the addition of (') notations for differentiation.

The primary distinction between the expansion joints of the first and second embodiments is that the center section 16' in joint 50 incorporates reinforcing edge members 52 of generally Z-shaped configuration which are bonded to the respective structural members 10 and 12 by means of a relatively thinner layer of bedding compound 19'. The recesses in the top surfaces of structural members 10 and 12 are also configured to receive the upper lateral portions of the edge members 52 therein.

Figure 7:
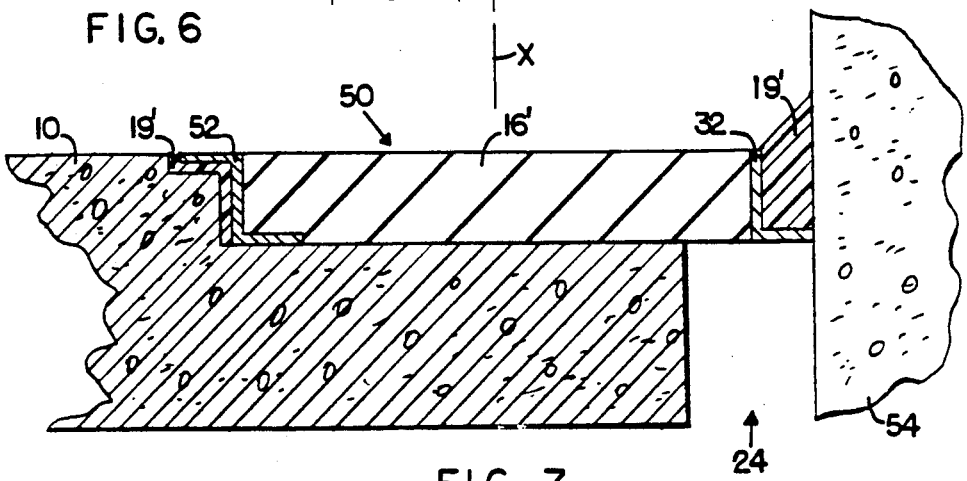
FIG. 7 is a vertical section view of the preformed expansion joint showing a modification of the second embodiment of the invention.

FIG. 7 shows a modification of the preformed expansion joint 50 which is adapted to seal the gap 24 between a horizontal structural member 10 and a vertical structural member 54 like that between a floor and wall. Instead of having two reinforcing edge members of the same profile, the preformed resilient center section 16' includes edge members 52 and 32 along opposite sides for bonding to the respective structural members 10 and 54 by means of bedding compound 19' as shown. Since a joint of this construction would typically be used along a wall, a traffic bearing plate 22 is not necessary.

From the foregoing, it will thus be apparent that the present invention comprises an improved preformed expansion joint system having several advantages over the prior art. One advantage is that the expansion system herein allows both minimal joint width and maximum bonding strength along the side edges of the preformed resilient center section, which are most susceptible to tearing. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. An expansion joint for sealing a gap between adjacent structural members having opposing recesses in the adjoining surfaces thereof, which comprises:

a stiff, generally flat traffic plate having opposite ends, one end of said traffic plate being secured within the recess of one structural member and extending across the gap with the other unsecured end thereof resting within the recess of the other structural member;

a preformed substantially continuous resilient center section resting on said traffic plate;

said preformed center section including an elastomeric portion with opposite longitudinal side edges, and longitudinal reinforcing edge members with inner and outer surfaces bonded by at least their inner surfaces directly to the side edges of the elastomeric portion; and means for adhesively securing the outer surfaces of the reinforcing edge members of said preformed center section directly to the respective structural members.

2. The expansion joint of claim 1, wherein said traffic plate is formed of metal.

3. The expansion joint of claim 1, wherein said traffic plate is formed of plastic.

4. The expansion joint of claim 1, wherein the elastomeric portion of said resilient center section is formed of epoxy modified urethane.

5. The expansion joint according to claim 4, wherein the epoxy modified urethane has a hardness of between 10° and 50° Shore A.

6. The expansion joint of claim 1, wherein the reinforcing edge members of said resilient center section are formed of fiber/epoxy composite material.

7. The expansion joint of claim 1, wherein the reinforcing members of said resilient center section are adhesively secured to the respective structural members with an adhesive epoxy paste.

8. The expansion joint of claim 1, further including:

a bond breaker sheet disposed between said traffic plate and said resilient center section.

9. The expansion joint of claim 1, further including:

a spacer plate positioned in the recesses on the other structural member in spaced relationship with the other end of said traffic plate.

10. The expansion joint of claim 1, wherein said resilient center section and the recesses in the structural members are symmetrical about a plane including a center line extending through the gap.

11. The expansion joint of claim 1, wherein said resilient center section and the recesses in the structural members are asymmetrical about a plane including a center line extending through the gap such that the gap is relatively closer to the secured end of said traffic plate.

12. An expansion joint for sealing a variable gap between adjacent structural members having opposing recesses in the adjoining surfaces thereof, comprising:

a stiff, generally flat traffic plate having opposite ends, said traffic plate being disposed within the recesses of the structural members and extending across the gap therebetween;

means for securing one end of said traffic plate to one structural member, the other end of said traffic being unsecured and resting upon the other structural member;

a spacer plate positioned within the recess of the other structural member in spaced relationship with the unsecured end of said traffic plate;

a preformed substantially continuous resilient center section resting on said traffic plate and said spacer plate, said center section including an elastomeric portion of epoxy modified urethane with reinforcing members of composite fiber-epoxy bonded along opposite edges thereof; and means for adhesively securing the reinforcing edge member of said resilient center section directly to the respective structural members.

13. The expansion joint of claim 12, wherein the epoxy modified urethane has a hardness of between 10° and 50° Shore A.

14. The expansion joint of claim 12, further including: a bond breaker sheet disposed between said traffic plate and said resilient center section.

15. The expansion joint of claim 12, wherein said preformed resilient center section and the recesses in the structural members are asymmetrical about a plane including a center line extending through the gap such that the gap is relatively closer to the secured end of said traffic plate.

16. The expansion joint of claim 12, wherein the reinforcing edge members are notched to facilitate rolling up of said resilient center section before installation.

17. An expansion joint for sealing a gap between adjacent structural members having opposing recesses in the adjoining surfaces thereof, comprising:

a stiff, generally flat traffic plate having opposite ends, said traffic plate being disposed within the recesses of the structural members and extending across the gap therebetween;

means for securing one end of said traffic plate to one structural member, the other end of said traffic plate being unsecured and resting upon the other structural member;

a spacer plate positioned within the recess of the other structural member is spaced relationship with the unsecured end of said traffic plate;

a bond breaker sheet disposed over said traffic plate and said spacer plate;

a preformed resilient center section resting on said bond breaker sheet, said traffic plate, and said spacer plate;

said preformed resilient center section including an elastomeric portion of epoxy modified urethane with reinforcing members of composite fiber-epoxy bonded along opposite edges thereof;

said preformed resilient center section and the recesses in the structural members being asymmetrical about a plane including a center line extending through the gap such that the gap is offset toward the secured end of said traffic plate; and means for adhesively securing the reinforcing edge members of said resilient center section directly to the respective structural members.

* * * * *